US007159364B2

(12) United States Patent
Rillie

(10) Patent No.: US 7,159,364 B2
(45) Date of Patent: Jan. 9, 2007

(54) SKYLIGHT FLASHING

(75) Inventor: David Windsor Rillie, Cardiff, CA (US)

(73) Assignee: Solatube International, Inc., Vista, CA (US)

( * ) Notice: Subject to any disclaimer, the term of this patent is extended or adjusted under 35 U.S.C. 154(b) by 964 days.

(21) Appl. No.: 09/376,461

(22) Filed: Aug. 18, 1999

(65) Prior Publication Data

US 2003/0150175 A1 Aug. 14, 2003

Related U.S. Application Data

(63) Continuation-in-part of application No. 09/126,331, filed on Jul. 30, 1998, now Pat. No. 6,035,593.

(51) Int. Cl.
*E04B 7/18* (2006.01)

(52) U.S. Cl. ..... 52/200

(58) Field of Classification Search ..... 52/200, 52/22, 28, 29, 39, 58, 219
See application file for complete search history.

(56) References Cited

U.S. PATENT DOCUMENTS 1,721,715 A * 7/1929 Schindler ..... 52/58
4,120,129 A * 10/1978 Nagler et al. ..... 52/219
4,172,691 A * 10/1979 Comstock et al.
4,549,379 A * 10/1985 Hoy et al. ..... 52/200
5,031,361 A * 7/1991 MacKay, Jr.
5,099,622 A * 3/1992 Sutton ..... 52/200
5,297,371 A * 3/1994 Borghetto ..... 52/308
5,655,339 A * 8/1997 DeBlock et al. ..... 52/200
5,878,539 A * 3/1999 Grubb ..... 52/200
5,896,712 A * 4/1999 Chao et al. ..... 52/200
5,896,713 A * 4/1999 Chao et al. ..... 52/200
5,956,191 A * 9/1999 Blackmon et al. ..... 359/846
5,983,581 A * 11/1999 DeBlock et al. ..... 52/200
RE36,496 E * 1/2000 Sutton ..... 52/200
6,044,592 A * 4/2000 Strieter ..... 52/27
6,263,624 B1 * 7/2001 Hoy et al. ..... 52/200
6,302,426 B1 * 10/2001 Denny

FOREIGN PATENT DOCUMENTS

DE 21 28 025 * 1/1973
DE 24 44 280 * 3/1976
EP 0 829 582 A2 * 3/1998
JP 58-24056 * 2/1983
WO WO 94/00654 * 1/1994

* cited by examiner

*Primary Examiner*—Richard E. Chilcot, Jr.
(74) *Attorney, Agent, or Firm*—John L. Rogitz

(57) ABSTRACT

A seamless skylight flashing has a frusto-conical curb defining an open top that can be covered by a skylight dome and an open bottom. A flat skirt extends radially away from the open bottom. Plural strengthening ribs are oriented radially on the skirt, and a peripheral rib is formed on the outer edge of the skirt. The skirt is preferably formed by die presses.

15 Claims, 6 Drawing Sheets

SKYLIGHT FLASHING

This is a continuation-in-part of U.S. Application No. 09/126,331 now U.S. Pat. No. 6,035,593, filed Jul. 30, 1998 and incorporated herein by reference.

FIELD OF THE INVENTION

The present invention relates generally to tubular skylights, and more particularly to roof-mounted flashings.

BACKGROUND

Tubular skylights have been provided for illuminating rooms inside buildings with natural light. Not only do tubular skylights thus save electricity and, concomitantly, are environmentally benign, but they illuminate rooms in a pleasing way using natural sunlight instead of 60 cycle electric light. An example of a commercially successful tubular skylight is disclosed in U.S. Pat. No. 5,099,622, assigned to the same assignee as the present invention and incorporated herein by reference.

A tubular skylight includes a roof-mounted, dome-like transparent cover. The cover is mounted on the roof of a building by means of a flashing. An internally reflective tube depends downwardly from the flashing to the ceiling of the room sought to be illuminated, and the bottom of the tube is covered with a disk-shaped light diffuser that is positioned at the ceiling.

A roof-mounted flashing typically includes a curb, the top of which is covered by the dome and the bottom of which engages a downwardly-depending skylight tube. A flat skirt is typically formed around the bottom of the curb, with the skirt extending radially away from the curb. The skirt is fastened to the roof such that the flashing provides an upper support for the skylight.

Past methods of making skylight flashings generally require a flat piece of sheet metal to be bent into the desired frusto-conical shape, with the opposed sides of the pieces that meet each other being welded of otherwise fastened together along a seam. Such seams, unfortunately, are unsightly and can fail, allowing dust to enter the skylight and degrade its light transmitting capabilities. Furthermore, the flat skirts, being made of sheet metal, ordinarily are not exceptionally strong. Consequently, the skirts can easily bend, warp, or otherwise become deformed, thereby interfering with the proper engagement of the flashing with a roof. The present invention recognizes the above problems and provides the below-disclosed solutions to one or more of the problems noted herein.

SUMMARY OF THE INVENTION

A tubular skylight includes a seamless flashing. A transparent dome is engaged with the flashing, and at least one skylight tube depends downwardly from the flashing.

In a preferred embodiment, the flashing includes a hollow frusto-conical shaped curb that has an open top which is covered by the dome. Also, the curb defines a bottom periphery opposite the open top, and a skirt extends radially outwardly away from the bottom periphery. In accordance with present principles, the skirt is formed with at least one surface strengthening anomaly such as a rib. More preferably, the skirt is formed with plural radial ribs, and the skirt can also be formed with a peripheral rib that extends along the outer periphery of the skirt.

In another aspect, a roof flashing includes a hollow frusto-conical shaped curb defining a bottom periphery. A skirt extends radially away from the bottom periphery. In accordance with the present invention, the skirt is formed with at least one surface strengthening anomaly.

In still another aspect, a method for making a flashing includes providing a flat piece of sheet metal, and engaging the sheet metal with a forming die. The forming die is actuated to establish a frusto-conical curb defining a top and a radial skirt extending away from the curb to establish a seamless stock flashing. The method then includes cutting a hole in the top of the curb with the same or another die, and forming at least one rib in the flashing using the same or another die.

In yet another aspect, a method for making a seamless skylight flashing includes forming a seamless stock flashing having a hollow curb that defines first and second ends and a skirt extending radially away from an end. At least one rib is then formed on the skirt. The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
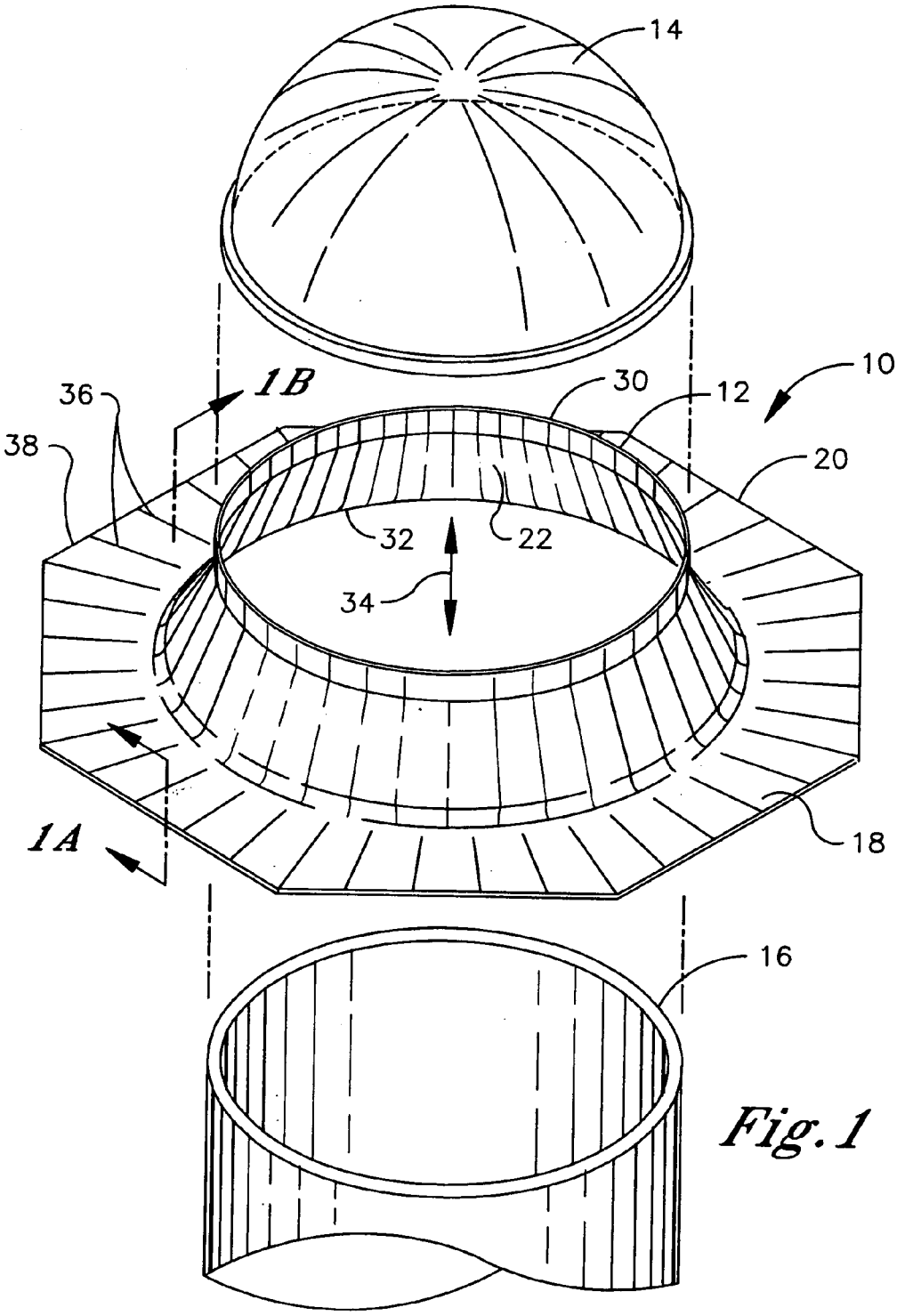
FIG. 1 is a perspective view of the flashing of the present invention in an exploded relationship with a roof-mounted dome and a skylight tube, with portions of the tube broken away for clarity.

Referring initially to FIG. 1, a tubular skylight is shown, generally designated 10, which includes a roof-mounted flashing 12 that supports a transparent plastic skylight dome 14 above a vertically-oriented internally reflective skylight tube 16 for lighting, with natural sunlight, an interior room in a building. In one embodiment, the dome 14 can be the cover disclosed in U.S. Pat. No. 5,896,712 for an invention entitled "LIGHT-COLLECTING SKYLIGHT COVER", owned by the same assignee as the present invention and incorporated herein by reference. Or, the dome 14 can be other suitable covers, such as the covers marketed under the trade name "Solatube" by the present assignee. On the other hand, the skylight tube 16 can be part of the skylight disclosed in the present assignee's U.S. Pat. Nos. 5,896,713 or 5,099,622, both of which are incorporated herein by reference, or the tube 16 can be part of other suitable skylights.

As shown in FIG. 1, the flashing 12 includes a flat skirt 18 that is attached flush to the roof by means well-known in the art. The skirt 18 defines an outer periphery 20 that, in the preferred embodiment, is octagonal shaped, it being understood that the periphery 20 can assume other shapes if desired.

Figure 2:
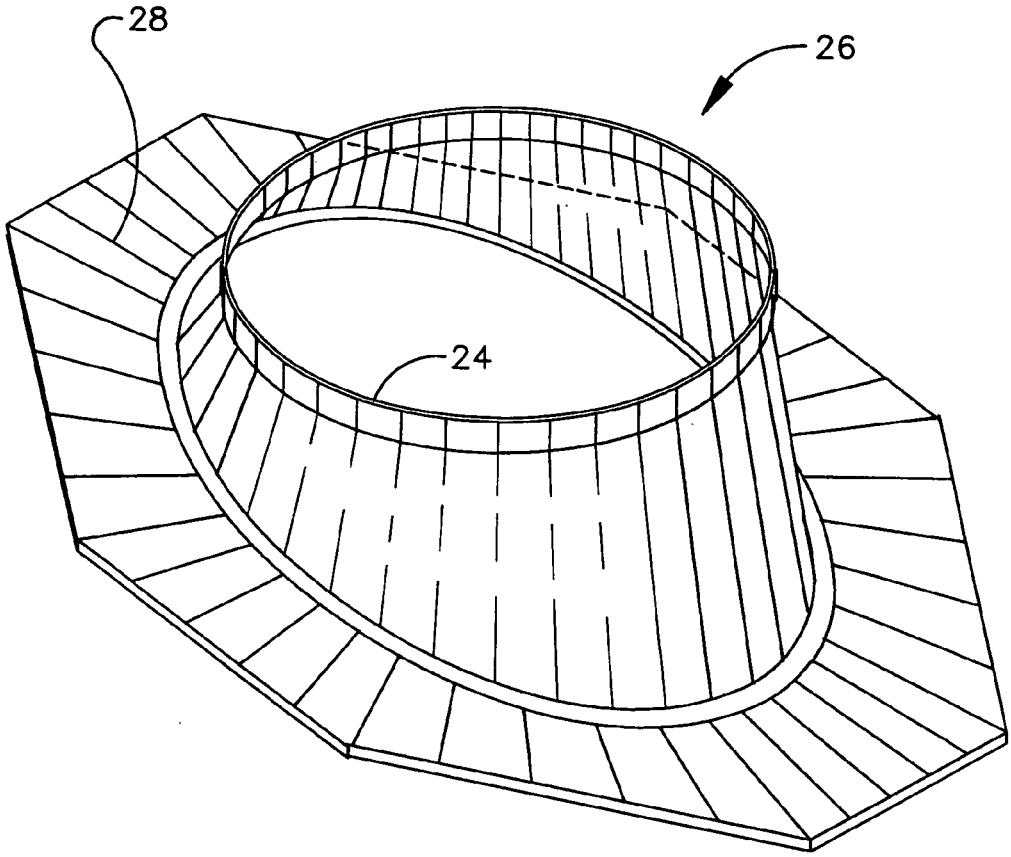
FIG. 2 is a perspective view of an alternate flashing having an oblique pitch.

A hollow curb 22, preferably frusto-conical shaped as shown, rises upwardly from the skirt 18. The curb 22 can define a right regular conical frustum as shown in FIG. 1, or, as shown in FIG. 2, a curb 24 of a flashing 26 made in accordance with present principles can define an oblique pitch relative to an associated skirt 28 as appropriate for the cant of a roof to engage and hold the dome 14 in a generally vertically upright orientation. It is to be understood that in all other essential respects the flashings 12, 26 shown in FIGS. 1 and 2 are identical to each other.

Accordingly, referring back to FIG. 1, the present curb 22 defines an open top end 30 that is covered by the dome 14 and an open bottom end 32 that is opposed to the top end 30. It can readily be appreciated in reference to FIG. 1 that the curb 22 defines a vertical axis 34, and that the skirt 18 blends into and extends outwardly away from the bottom end 32 in a radial dimension that is orthogonal to the axis 34. Owing to the below-described manufacturing process, at least the curb 22 and preferably also the skirt 18 are seamless.

FIG. 1 shows that the skirt 18 is formed with plural elongated strengthening ribs. More specifically, the skirt 18 is formed with plural elongated radial ribs 36 that are oriented radially on the skirt 18. Also, in the preferred embodiment a peripheral rib 38 is formed on the periphery 20 of the skirt 18. We have found that for optimum stiffening, the peripheral rib 38 should be formed as shown, i.e., on the extreme outer periphery of the skirt 18, with no portions of the skirt 18 extending radially outwardly beyond the peripheral rib 38. The ribs 36, 38 shown herein are examples of surface strengthening anomalies.

Figure 1A:
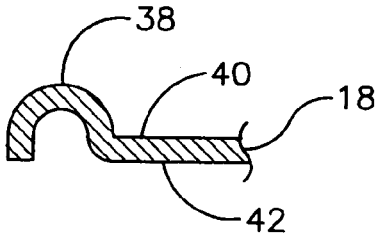
FIG. 1A is a cross-sectional view of the peripheral rib as seen along the line 1A—1A in FIG. 1.

FIG. 1A shows that the skirt 18 defines an upper surface 40 and a lower surface 42, and that the peripheral rib 38 can rise above the upper surface 40. Or, the peripheral rib 38 can extend below the lower surface 42 of the skirt 18. In either case, the peripheral rib 38 can be thicker than the skirt 18. Alternatively, as shown the peripheral rib 38 can have the same thickness as the skirt 18 and be trough-shaped, as is the case with the radial ribs 36.

Figure 1B:
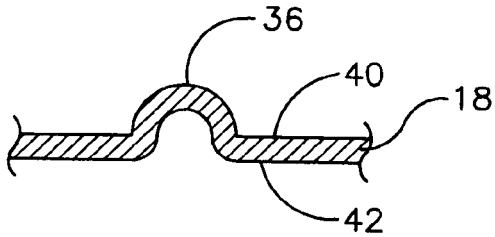
FIG. 1B is a cross-sectional view of a radial rib as seen along the line 1B—1B in FIG. 1.

Indeed, turning now to FIG. 1B, as shown each radial rib 36 can be formed as a trough-like structure that rises in a curve above the upper surface 40 of the skirt 18. It is to be understood that depending on whether the male part of the ribbing die disclosed below has rib-forming flutes, or the female part of the ribbing die has rib-forming flutes, the radial ribs 36 could alternatively be formed as trough-like structures that dip below the lower surface 42 of the skirt 18. Stated differently, each radial rib has a concave surface and an opposed convex surface, and the concave surface can be contiguous to the upper surface 40 of the skirt 18 with the convex surface being contiguous to the lower surface 42, or vice-versa. In either case, the thickness of each radial rib 36 can be equal to the thickness of the skirt 18.

Figure 3:
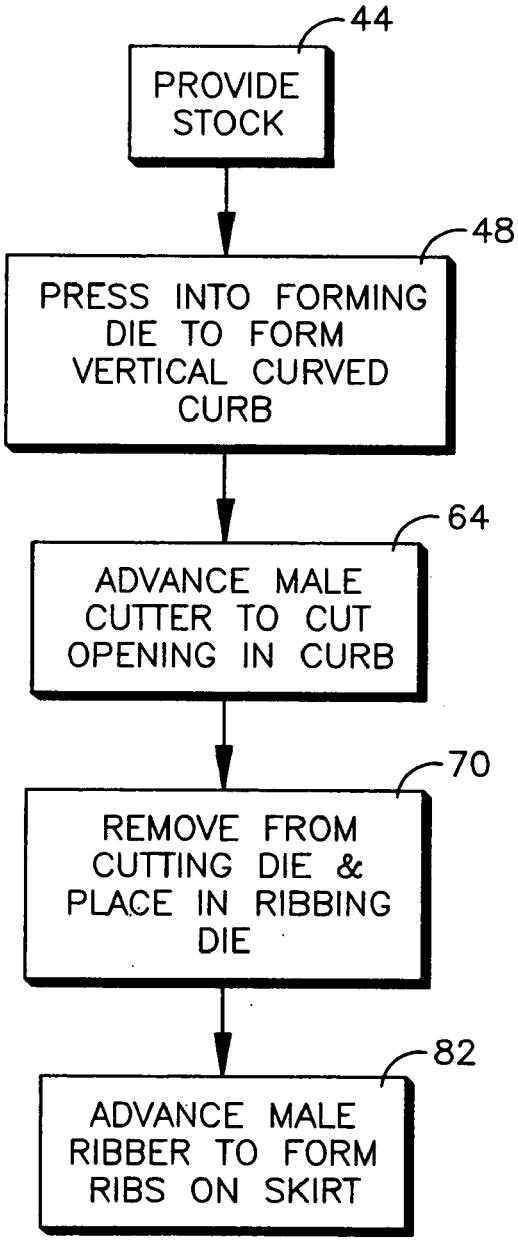
FIG. 3 is a flow chart of the present flashing manufacturing process.
Figure 4:
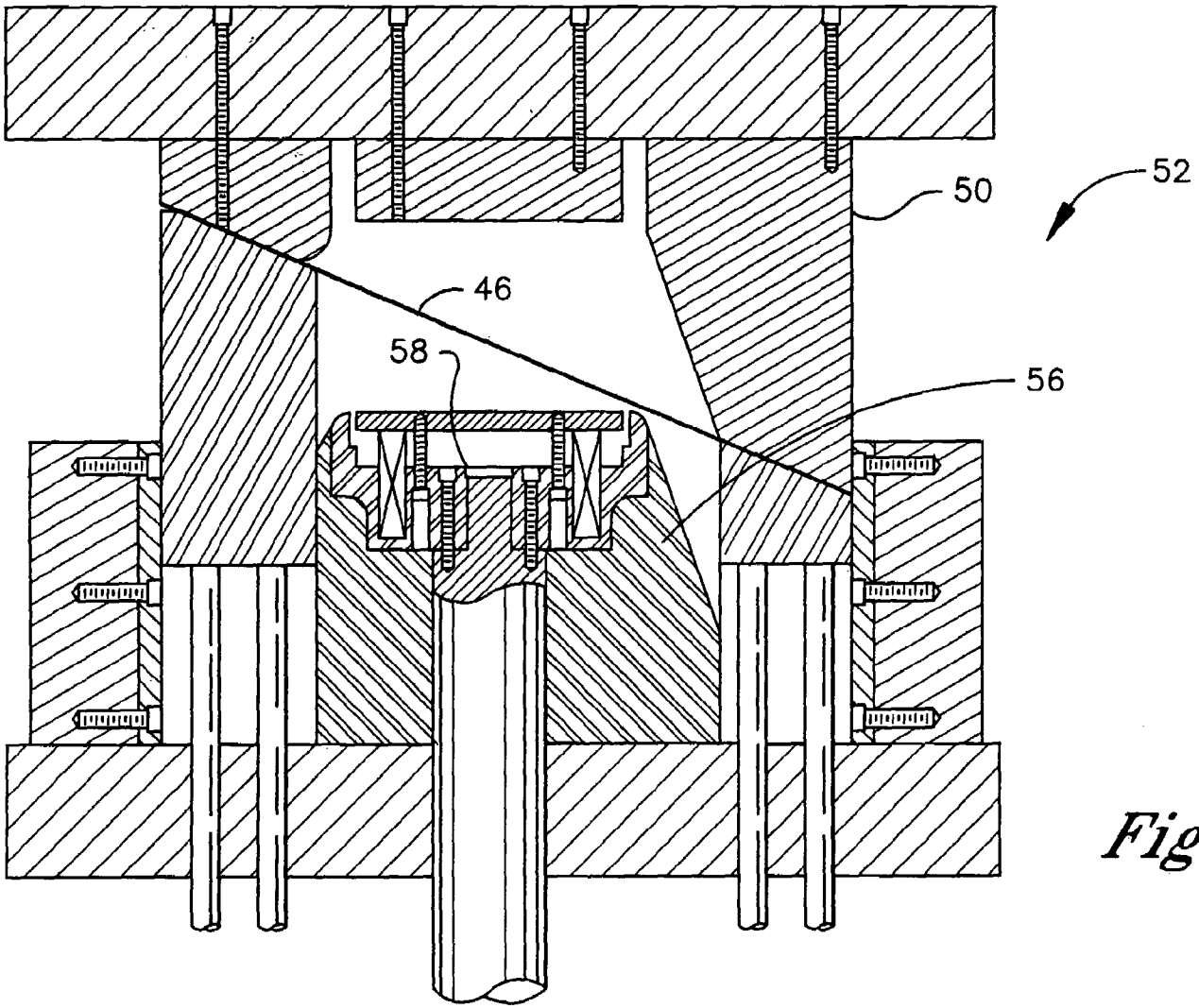
FIG. 4 is a cross-sectional diagram of a combined forming and cutting die, with the male part distanced from the female part.
Figure 5:
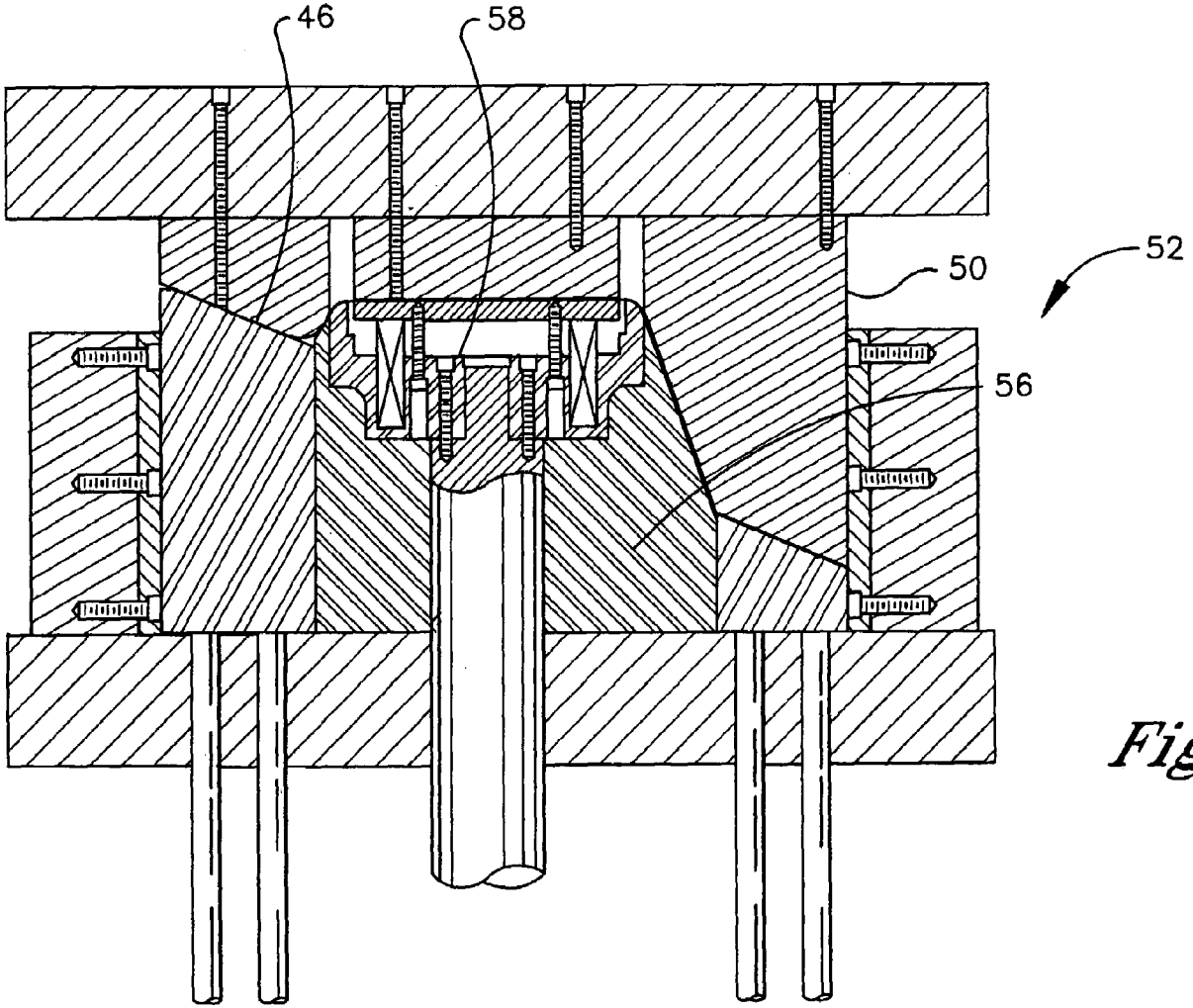
FIG. 5 is a cross-sectional diagram of the die shown in FIG. 4, with the male part engaged with the female part to form the flashing.
Figure 6:
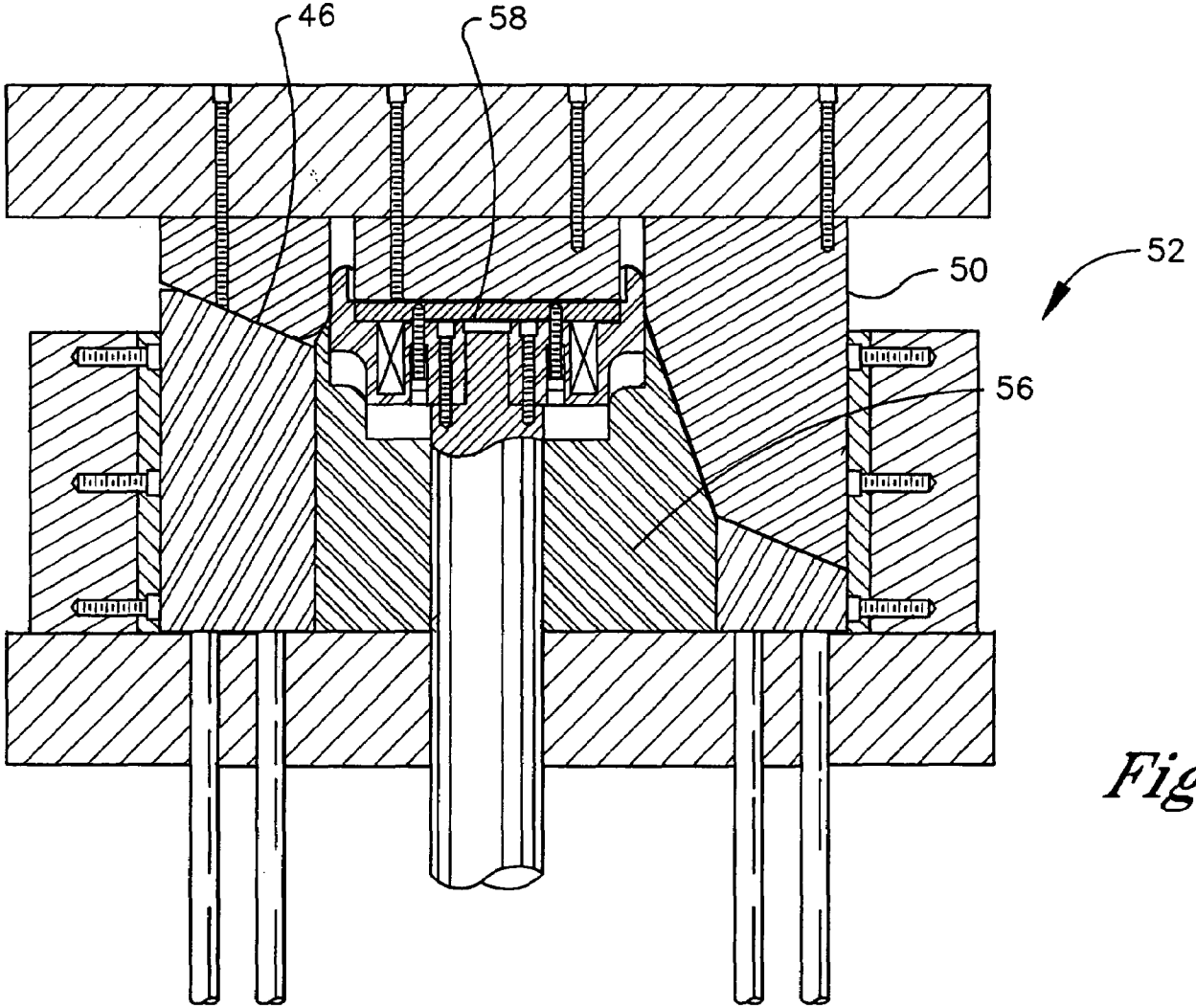
FIG. 6 is a cross-sectional diagram of the die shown in FIG. 4, with the cutting part advanced to cut the open top end in the flashing.

FIG. 3 shows the manufacturing process of the present invention. Commencing at block 44, a piece of flat stock sheet metal is provided. Such a piece is shown in FIG. 4 and designated 46. Next, at block 48 the piece 46 is positioned under a female part 50 of a combined forming and cutting die, generally designated 52. The female part 50 preferably has the shape of the curb that is desired to be formed from the piece 46. As can best be appreciated in reference to FIG. 5, a male part 56, preferably having the shape of the curb that is desired to be formed from the piece 46, is pressed into the piece 46 to form a stock flashing as shown further below.

In the preferred embodiment, two separate dies are used, it being understood that a single die could be constructed having plural male parts as appropriate to undertake the method shown herein. Or, more than two dies can be used. When two dies are used, however, a male cutting part 58 that is centrally located with respect to the male part 56 is advanced into the stock 46 to form the open top end 30 (FIG. 1) of the flashing, as indicated at block 64 in FIG. 3.

Figure 7:
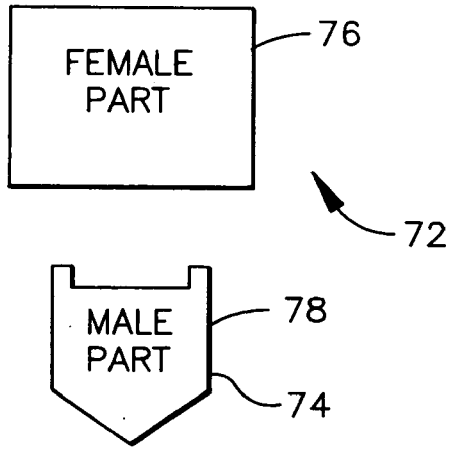
FIG. 7 is a schematic exploded diagram of a ribbing die.

Once the open top end has been formed, the stock flashing is removed from the combined forming and cutting die 52 at block 70 of FIG. 3 and engaged with a ribbing die, generally designated 72 and shown in FIG. 7. The ribbing die 72 includes a male part 74 that is advanced upwardly against the stock flashing, which is held by a female part 76. Either the male part 74 can be formed with ribbing features 78 as shown to form the ribs 36, 38 of the flashing 12 shown in FIG. 1, or the female part 76 can be formed with convex or concave flutes to form the ribs 36, 38, or both parts 74, 76 can be formed with flutes. In any case, at block 82 the male part 74 is pressed onto the stock flashing, which is sandwiched between the male and female parts 74, 76, to press-form the ribs 36, 38 on the skirt 18 (FIG. 1).

While the particular SKYLIGHT FLASHING as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for".

What is claimed is:

1. A tubular skylight comprising:

a seamless metal flashing;

a transparent dome engageable with the flashing;

at least one skylight tube depending downwardly from the flashing, wherein the flashing comprises:

a hollow frusto-conical shaped curb defining an open top, the open top being covered by the dome, the curb defining a bottom opposite the open top and not including a strengthening rib; and a skirt extending radially away from the bottom of the curb, wherein the skirt defines a radial dimension, and the skirt is formed with plural ribs, each rib being oriented radially on the skirt, the skirt defining an outer periphery, a peripheral rib being formed along at least part of the periphery, the skirt not extending beyond the peripheral rib.

2. The skylight of claim 1, wherein the curb defines a right regular conical frustum.

3. The skylight of claim 1, wherein the curb defines an oblique pitch relative to the skirt.

4. The skylight of claim 1, wherein the curb defines a vertical axis, the skirt blending into and extending outwardly away from the bottom in a radial dimension that is orthogonal to the axis.

5. The skylight of claim 1, wherein at least the curb is seamless.

6. The skylight of claim 1, wherein the skirt defines an upper surface and a lower surface, the peripheral rib rising above the upper surface.

7. The skylight of claim 1, wherein the skirt defines an upper surface and a lower surface, the peripheral rib extending below die lower surface.

8. The skylight of claim 1, wherein the peripheral rib is thicker than the skin.

9. The skylight of claim 1, wherein the peripheral rib has the same thickness as the skirt.

10. The skylight of claim 1, wherein at least one rib is trough-shaped.

11. The skylight of claim 1, wherein the plural ribs are radial ribs, and at least one radial rib rises in a curve above an upper surface of the skirt.

12. The skylight of claim 1, wherein the plural ribs are radial ribs, and at least one radial rib dips below a lower surface of the skirt.

13. The skylight of claim 1, wherein the plural ribs are radial ribs, and each radial rib has a concave surface and an opposed convex surface, the concave surface being contiguous to an upper surface of the skirt and the convex surface being contiguous to a lower surface of the skirt.

14. The skylight of claim 1, wherein the plural ribs are radial ribs, and each radial rib has a concave surface and an opposed convex surface, the concave surface being contiguous to a lower surface of the skirt and the convex surface being contiguous to an upper surface of the skirt.

15. The skylight of claim 1, wherein the plural ribs are radial ribs, and the thickness of each radial rib Is equal to the thickness of the skirt.

* * * * *